US007210576B2

(12) United States Patent
Lam

(10) Patent No.: US 7,210,576 B2
(45) Date of Patent: May 1, 2007

(54) GARMENT HANGER RETAIL PACKAGE

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 176 days.

(21) Appl. No.: 10/044,685

(22) Filed: Jan. 11, 2002

(65) Prior Publication Data

US 2003/0205592 A1 Nov. 6, 2003

(51) Int. Cl.
*B65D 85/00* (2006.01)

(52) U.S. Cl. ..... 206/300; 206/806

(58) Field of Classification Search ..... 206/285, 206/300, 495, 806; 223/87, 98; 40/332
See application file for complete search history.

(56) References Cited

U.S. PATENT DOCUMENTS 1,682,106 A * 8/1928 Banks ..... 40/322
1,733,825 A * 10/1929 Rosenthal ..... 206/574
1,877,840 A * 9/1932 Frowenfeld ..... 206/479
2,861,726 A * 11/1958 Whyte ..... 223/92
3,124,284 A * 3/1964 Collum ..... 223/98
3,162,341 A * 12/1964 Strampe ..... 223/87
3,231,159 A * 1/1966 Taff ..... 223/98
3,357,544 A * 12/1967 Gingher ..... 206/300
3,428,229 A * 2/1969 Irving ..... 223/87
3,563,372 A * 2/1971 Baum et al. ..... 206/343
4,137,661 A * 2/1979 Johansson ..... 40/322
4,944,436 A * 7/1990 Moen et al. ..... 223/98
5,135,141 A * 8/1992 Harmer et al. ..... 223/85
5,176,252 A * 1/1993 Davis ..... 206/300
5,423,139 A * 6/1995 Feldman ..... 40/673
5,597,100 A * 1/1997 Blitz ..... 223/85
5,896,991 A * 4/1999 Hippely et al. ..... 206/461
5,962,834 A * 10/1999 Markman ..... 235/385
6,145,233 A * 11/2000 Hickmott ..... 40/673
6,209,763 B1 * 4/2001 Rahmey ..... 223/88

* cited by examiner

*Primary Examiner*—David Fidei

(57) ABSTRACT

Embodiments of garment hangers retail package comprising a display tag having a substantial display area located on top of the garment hanger supporting arms for illustrating the specialty features of the garment hanger. The display tag is sandwiched in between the first two hangers in a retail package of multiple hangers.

21 Claims, 3 Drawing Sheets

GARMENT HANGER RETAIL PACKAGE

FIELD OF THE INVENTION

The present invention relates to packaging design unique to garment hangers for retail purposes.

BACKGROUND OF THE INVENTION

Garment hanger is a commodity houseware product having a long history. Typically a garment hanger comprises of a suspension member represented by a hook and a pair of supporting arms extending from the two sides of the suspension member for supporting a garment. Optional features of garment hangers comprise of pant bars or clips. High-end garment hangers are mostly sold piece by piece. Lower cost hangers are mostly bundled from two to ten hangers per pack for retail. Since garment hangers are commodity item that most people understand how to use, the prior art packaging designs of garment hangers are usually kept simple to minimize the product cost. Besides most consumer understands the look of a garment hanger, there is little incentive for packaging designer to provide a packaging design that gives the full frontal view of the hanger. Accordingly the packaging designs of most single pack retail hangers are in the form of a small freely suspended hang tag. The most common prior art packaging design for multiple hangers is simply a card wrapped around the arms or the medial portions of the hangers stacked together. When a sophisticated reciprocal adjustable garment hanger was promoted, it was discovered that the low cost garment hanger packaging designs commonly used in the art do not provide adequate display area to illustrate sales related information, such as the special benefits, features and operation of the reciprocal adjustable garment hangers. The need of a substantially larger display area on the packaging without affecting the display arrangements in the retail stores is identified for educating the consumer the benefits of a personalized fitted hangers.

It is the goal of the subject invention to provide a retail packaging assembly unique to the structures of garment hangers, particularly a design having a significantly large display area to illustrate the operation of specialty garment hangers, such as an adjustable hanger. The second objective is to offer a low cost packaging design allowing the full frontal view of the adjustable hanger to be shown to the customers visiting the stores, so as to stimulate their attention about the special features offered by the hangers, such as the see through adjusting mechanism, or the movable arms of an adjustable garment hanger, as illustrated in applicants issued U.S. Pat. Nos. 5,511,701 and 5,644,710. It is also an objective of the invention to provide a most suitable position on the display tag to print the "Try-Me" message which directs the attention of the consumer to the moving arms of an adjustable garment hanger.

SUMMARY OF THE INVENTION

The present invention is directed to packaging design unique to retail garment hangers. Traditional garment hanger comprises a suspension member and two supporting arms extending from the two sides of the suspension member for supporting a garment. Typical optional features of a garment hanger may include a pant bar or a clips assembly connected to the bottom remote ends of the supporting arms. The triangular structure of a garment hanger makes it a bulky size item to be shipped, stored and displayed in the store.

Accordingly it is also a desirable feature of the packaging study to provide a display packaging design that does not interfere with the shipping case, and also be able to optimize the display arrangement in the stores.

In a first embodiment of the invention, a flat sheet of display tag is provided to illustrate the benefits as well as the unique functional features of the specialty hanger. Accordingly to a study of the invention, the area above the shoulder supporting arms of the hangers constitutes a good location for the display tag. This location is preferably to be properly designed and dimensioned, so as not to interfere with the shipping case of the hangers. In addition, unlike the area beneath the medial portion of the hanger, the area above the shoulder supporting arms is usually an area not being utilized by the retail stores to show the price tag of the retail hangers. Since this area is positioned on top of the movable arms, it is also a perfect location to put the "Try-Me" message encouraging the consumer to try the special adjustable feature of the hanger, represented by the movable hanger arms located beneath the message. For the hangers that come with a pant bar or clips, the area beneath the medial portion of the hangers and the pant bar or clips is a second preferred location for sales information display. In order to prevent the display tag to be damaged during transportation, the size of the display tag should be equal or smaller than the footprint of the hanger. The portion of the display tag above the hanger arms is preferred to be within the periphery defined by the straight line connecting the hook and the remote shoulder tips of the supporting arms. Photographs and promotional messages can be printed on both sides of the display tag.

The next design challenge is to research the method for attaching the display tag to the garment hanger assembly without blocking the full frontal view of the hanger. This is particularly important for an adjustable garment hanger as the adjustment mechanism or the special adjustable moving arms of the hanger constitutes the key special features for the unique adjustable hangers to define over the regular garment hangers. For a single pack retail hanger, the display tag is preferred to be securely attached behind the garment hanger. Three attachment points are recommended for attaching the display tag to the hanger. The first attachment point is around the hook area. The other two attachment points are recommended to locate around the two supporting arms. For an adjustable garment hanger, part of the supporting arms are movable, therefore the two lower attachment points are recommended to locate either in between the medial portion and the movable arms, or close to the ends of the medial portion. The means of connection is typically provide by cable ties or straps tying the hanger and the display tag together. According to the design objective of the invention, the strap is recommended to be invisible to the consumer when the hanger is displayed. Accordingly the strap should be made with transparent material or of the same color as the hanger. Two slots are provided on each side of the display tag for dressing the strap. At the last stage of the display assembly, the strap may be secured at the back of the display tag by Scotch tape.

The suspension hook is thin for many attachment designs. In order to save cost, a flap is folded from the display area of the display tag for attaching to the hanger hook. A hole is required on the flap for the hook to dress into the flap. In order to improve the efficiency of the assembly operation in the factory, the hole may be formed in the shape of cross cut slits for easier aligning the hanger hook with the hole.

In the situation of multiple hangers retail package, the display tag is recommended to be positioned behind the first hanger of the package, and in front of the other hangers in the bundle. Since the display tag is sandwiched in between two hangers, it is more securely attached to the assembly than the single pack hanger. Accordingly only two attachment points may be required. Similar to the single pack hanger packaging design, holes or slots are provided on the display tag and the hangers are tied together by cable ties or straps. Because a portion of the display tag is blocked by the hangers behind, only the position above the supporting arm on both sides of the display tag are available for printing sales related information, such as photographs and promotion messages.

In another preferred embodiment suitable for use with hangers with clips or pant bar, the display tag is extended beyond the lower far ends of the supporting arms but short of the position of the clips or pant bars. Photographs and promotional messages are printed onto this lower portion or at the back of the display tag.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
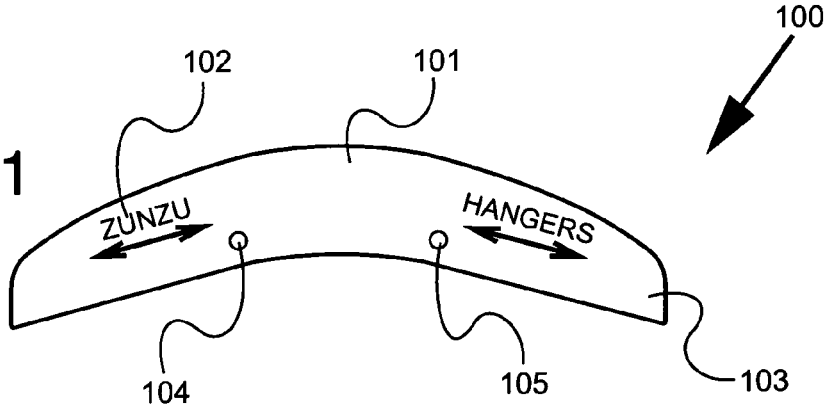
FIG. 1 is the front view of a preferred embodiment of the garment hanger display tag.

Attention is first directed to FIG. 1, which illustrates the front view of a garment hanger display tag 103. The display tag has two holes 104 and 105 offset from the center line of the display tag. Around the upper portion of the display tag, promotional messages 102 are printed. Suitable graphic may be added to inform the customer what kind of special features is provided by the specialty hanger being promoted.

Figure 2:
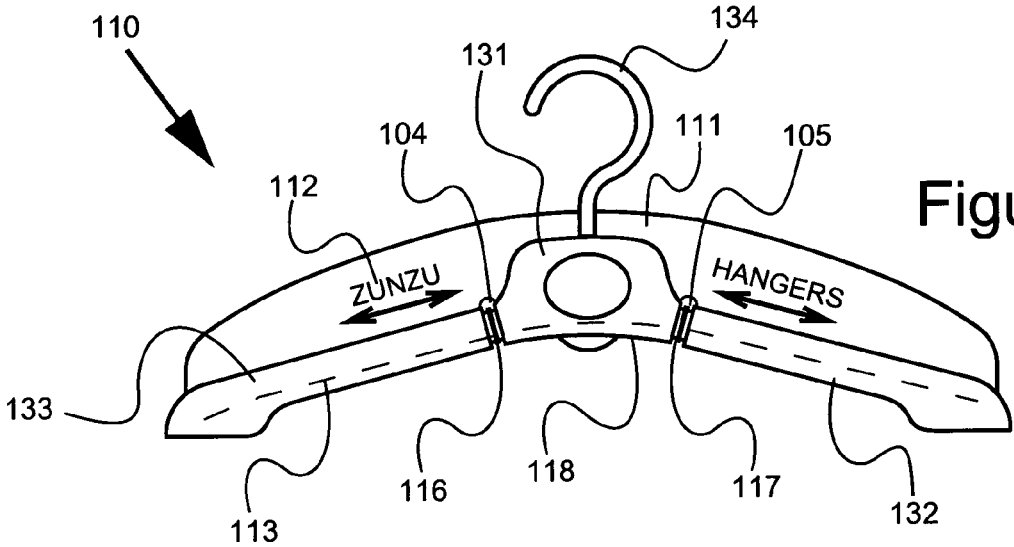
FIG. 2 demonstrates a two positions attachment design; it also illustrates the position of the tag relative to the garment hanger.

Attention is now directed to FIG. 2, which demonstrates a preferred embodiment of the retail garment hanger packaging. The garment hanger under promotion comprises a medial portion 131. Extended from the medial portion 131 are a suspension member 134, and two supporting arms 132 and 133. In the situation that the specialty hanger 110 is an adjustable width garment hanger, each of the supporting arms 132 and 133 comprises a stationary supporting arm extended from the medial portion 131 and a movable arm traveling relative to the stationary supporting arm for adjusting the garment supporting width. Each moving arm is linked to a transfer mechanism located inside the medial portion 131 to provide a reciprocal adjustment effect. Behind the garment hanger is the display tag 100 of FIG. 1. Two cable ties, each dress through the holes 104 or 105 of the display tag securely attached the display tag at the rear side of the adjustable hanger. The cable ties 116, 117 are recommended to locate in between the medial portion 118 and the movable arms 132 and 133 so as to minimize the visual significance of the cable ties. The color of the cable tie is preferable to be transparent or identical to the color of the garment hanger. In case of an adjustable garment hanger, it is also a desirable feature for the medial portion to be of different color as compared with the color of the movable arms, to indicate that the movable arms are not part of the medial portion. From here it can be observed that the substantial full frontal view of the adjustable hanger is displayed in front of the consumer shopping in the store. Unlike the traditional hanger packaging having a message located right at the center of the medial portion, the unique characteristic of this packaging design is that the most significant area for the promotion message locates on top of the hanger arms. This is an area perfect to print the graphic and message, such as a "Try Me" message, that the arms below the message are adjustable. It can be observed that the bottom edge of the display tag 113 locates at a position short of the tower edge 118 of the hanger. The benefits of this arrangement is that another pack of hanger can be displayed immediately below the upper hanger in the store, so as to make optimal use of the store display area and to stock maximum number of hangers on the display rack.

Figure 3:
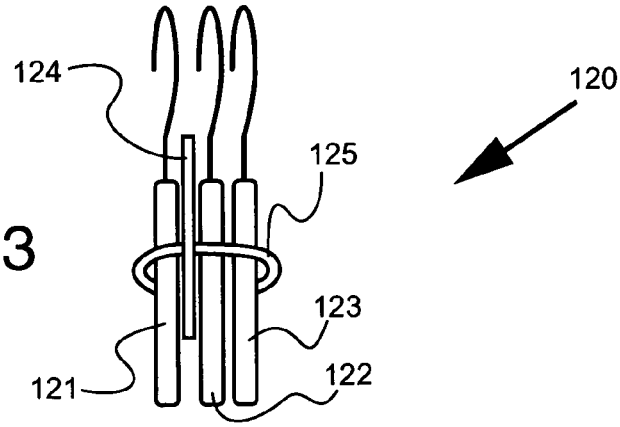
FIG. 3 illustrates the side view of the garment hanger retail package.

FIG. 3 illustrates the position of the display tag in the design of multiple hangers retail package. The display tag 124 is sandwiched in between the first two hangers of the package. Two cable ties dressing through the holes 104, 105 of the display tag firmly tie all the hangers together. This structure enables the display tag to be securely positioned in the package although only two attachment points represented by the holes 104, and 105 are provided by the design.

Figure 4:
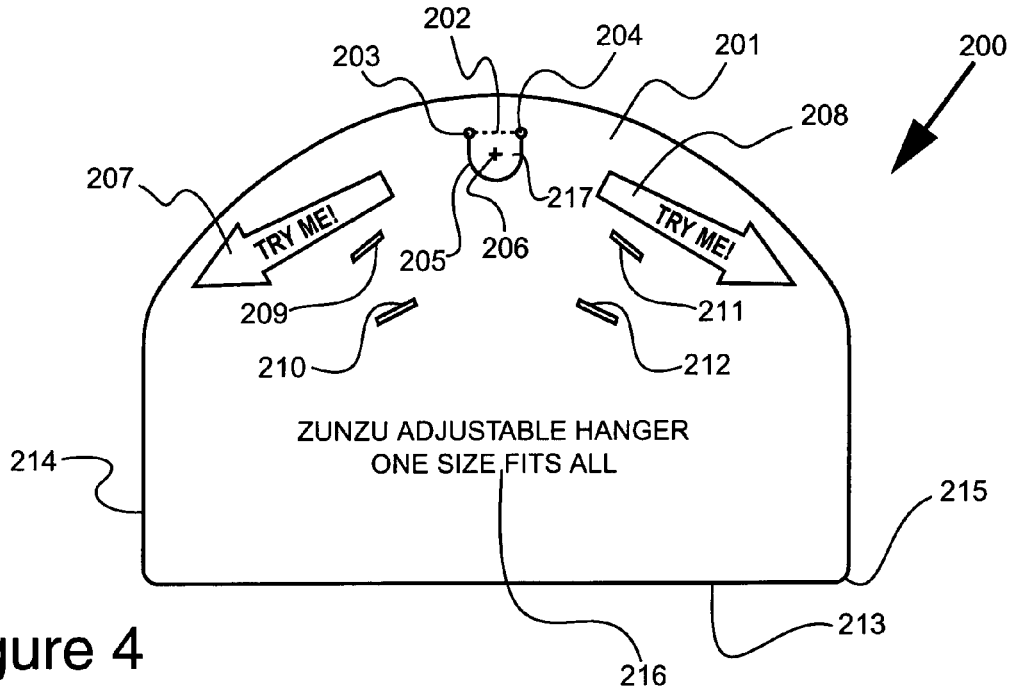
FIG. 4 is the front view of another preferred embodiment configured for a hanger with clips or pant bar.

Attention is now directed to FIG. 4, which illustrates an alternate embodiment of the display tag. This display tag is designed for use with a hanger that comes with clips or a pant bar. Accordingly the bottom edge of the display tag is extended to a location slightly short of the position of the pant bar or the clips to avoid damaging the display tag inside the shipping case during transportation. Promotion messages or photographs are printed on top of the hangers arms as well as the location beneath the medial portion of the hanger. Each of the attachment holes 104 and 105 of FIG. 1 are modified to a pair of slots 209/210 and 211/212. Around the upper edge of the display tag is a flap 217 folded along the line 202. Located on the flap is a hole 206 for attaching to the hook of the garment hanger. This display tag requires three attachment points defined by the folded flap and the pairs of slots 209/210 and 211/212.

Figure 5:
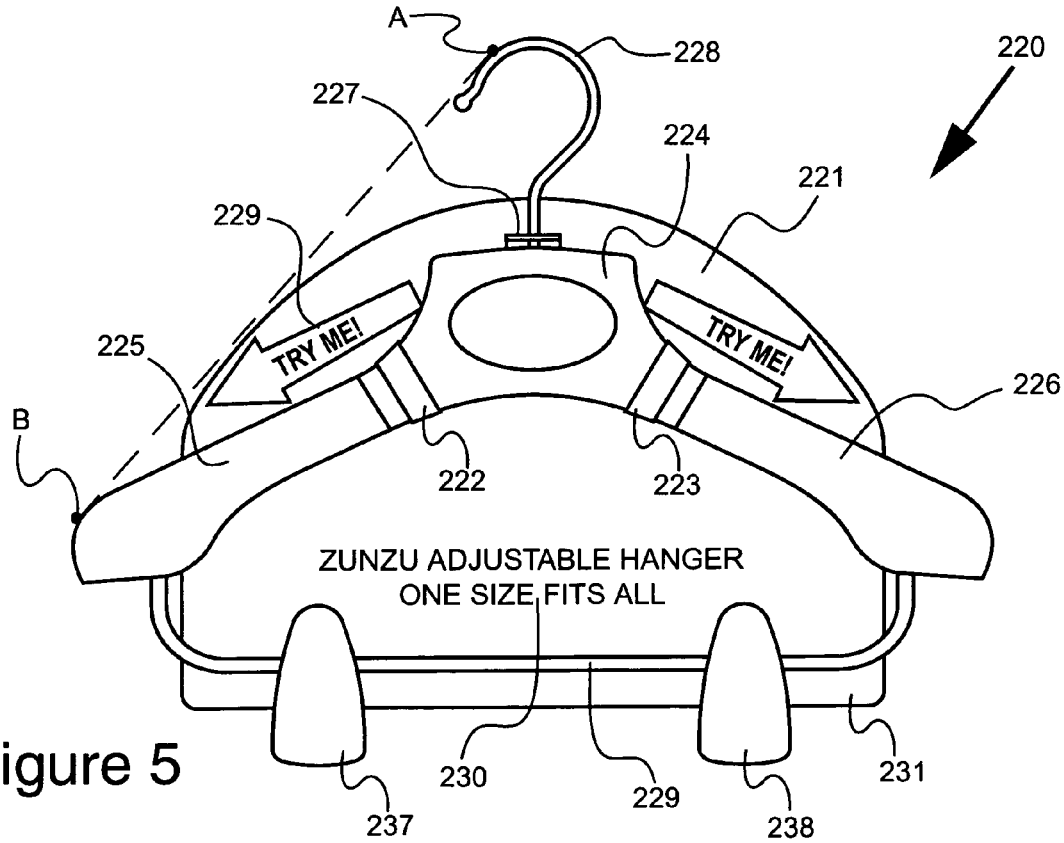
FIG. 5 illustrates the position of the display tag in a three points attachment design.

FIG. 5 illustrates the front view of the specialty hanger after it is assembled with the display tag 200 of FIG. 4. The flap 227 is fold to a position approximately perpendicular to the display tag 221. The suspension member 228 is then dressed through the hole 206 of the flap 227. Two strips or straps 222 and 223 fasten the lower side of the display tag 221 to the medial portion 224 of the hanger without interfering the movement of the movable arms 225 and 226. The fastening straps are configured to provide a substantial full natural front view of the hanger. Accordingly the fastening straps are either transparent or of a color similar to the portion of the hanger located behind the strips. Although the flap 227 and the strips 222, 223 do not allow the packaging to provide an "exactly" full frontal view of the hanger 224, the thin flap 227 and the transparent or matching color strips 222, 223 are almost invisible that they successfully give the consumer an impression how the full frontal view of the hanger look alike. This illusion of a full frontal view of the hanger defines the term "substantial full frontal view" used in this application. A promotional message such as a "Try Me" sign 229 is printed on top of the hanger arms to indicate that the hanger arms are movable. Beneath the medial portion of the hanger are other promotion messages or photographs demonstrating the benefits of the specialty hanger. It should be noted that the periphery of the display tag 221 is preferably designed in a shape suitable for the hangers to be packed in a shipping case. Accordingly the display tag is positioned to be short of the virtual line connecting points A and B as shown in FIG. 5. The bottom edge of the display tag is also preferably to be cleared from the bottom of the pant bar or the clips 237, 238 of the hanger. The display areas 207, 208 of the display tag of FIG. 4 define two prominent displaying regions, each positioned vertically above the supporting arms 225 and 226 when the display tag of FIG. 4 is assembled with a garment hanger as illustrated in FIG. 5. In the design of this embodiment, the region of the display tag positioned above the medial portion 224 of the garment hanger comprises a flap 227 for attaching the display tag with the garment hanger.

Figure 6:
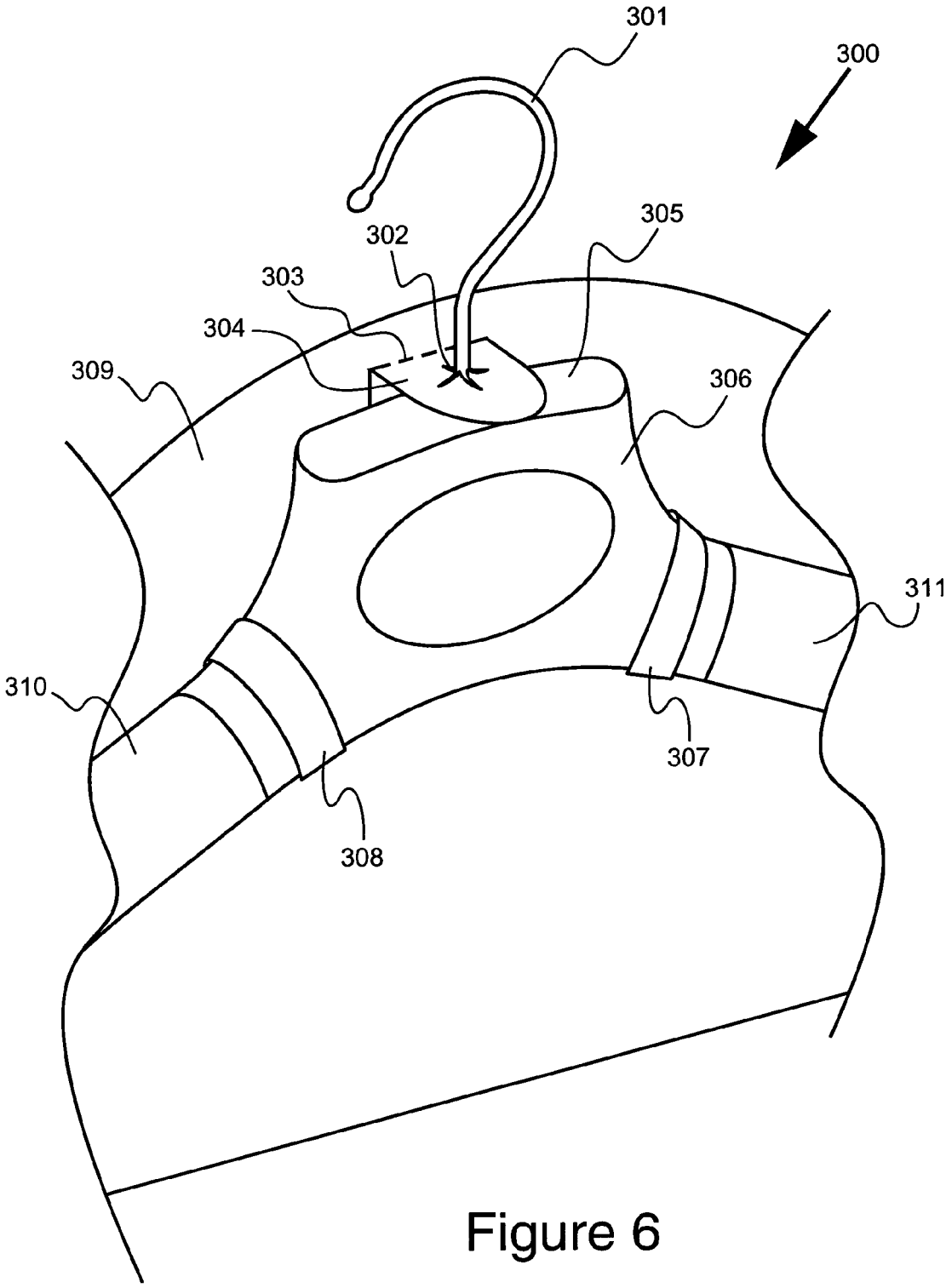
FIG. 6 demonstrates the folded flap attachment design and the strap attachment design.

FIG. 6 illustrates an enlarged view of the folded flap attached to the hook of a hanger. The flap 304 is folded along the line 303. The center of the hole 302 is of a distance "L" from the folded line where "L" is also the distance measured from the position of the hook to the rear surface of the hanger. The folded flap design is therefore a better fastening design than the straps because it support and maintain the separation distance of the hook from the display tag. The straps 307 and 308 tie the medial portion of the hanger to the lower side of the display tag 309. The straps 307 and 308 are recommended to be clear from the movable portions 310, 311 of the hanger supporting arms.

In reviewing the common properties of the various embodiments described, it can be observed that the display tag provides at least two attachment points to the garment hanger in front. A third attachment point is recommended to be a flap folded from the display tag for attaching to the hook of a garment hanger. The bottom attachment points are recommended to be represented by transparent fasteners or fasteners with color similar to the hanger behind, so as to provide a full natural front view of the uniquely designed hanger. A substantial display area provided on top of the hanger supporting arms is particularly a perfect location for displaying a message indicating that the moving arms beneath are adjustable. When the display tag is applied to a multiple hangers package, the display tag is recommended to be sandwiched between the first two hangers.

It is submitted that any other alternate designs capable to serve the predefined application objectives are included in the scope of this invention. Similarly, different structural designs capable of attaching a flat display member to a package of garment hanger are also included in the scope of this invention. The preferred embodiments of the invention described herein are exemplary and numerous modifications, dimensional variations and rearrangements can be readily envisioned to achieve an equivalent result, all of which are intended to be embraced within the scope of the appended claims.

I claim:

1. A garment hanger retail package comprising:

at least a first and a second garment hanger; each garment hanger having a suspension member and two support arms extending from opposite directions of said suspension member for supporting a garment; and a display tag positioned in front of said second garment hanger and behind said first garment hanger, said display tag is further provided a display area extending along the extension of said support arms;

wherein said retail package further comprising means to combine said garment hangers and said display tag to form said garment hanger retail package.

2. The garment hanger retail package of claim 1 wherein said display area is positioned substantially on top of said support arms.

3. The garment hanger retail package of claim 1 further comprising fastening means for attaching at least two points of said first garment hanger to said display tag.

4. The garment hanger retail package of claim 3 wherein said fastening means comprises a flap folded from said display tag.

5. A garment hanger retail package comprising:

at least one garment hanger having a suspension member and two support arms extending from opposite directions of said suspension member for supporting a garment;

a display tag positioned below said suspension member and secured behind said garment hanger for providing a substantial full frontal view of said garment hanger and for defining a display area; and fasteners provided for attaching at least two points of said garment hanger to said display tag.

6. The garment hanger retail package of claim 5 wherein said fasteners comprise a transparent strap.

7. The garment hanger retail package of claim 5 wherein said fasteners comprise a strap similar in color to a portion of the hanger fastened by the strap.

8. The garment hanger retail package of claim 5 wherein said fasteners comprise a flap folded from said display tag.

9. A garment hanger retail package comprising:

at least one garment hanger having a suspension member and two support arms extending from opposite directions of said suspension member for supporting a garment; and a display tag secured behind said garment hanger for defining a display area and for providing a substantial full frontal view of said garment hanger, wherein said display tag comprises a folded flap engaged with the suspension member of said garment hanger.

10. The garment hunger retail package of claim 9 wherein said folded flap comprises a hole for fitting said suspension member.

11. The garment hanger retail package of claim 9 wherein said hole is provided by at least one slit.

12. The garment hanger retail package of claim 9 wherein said display area is positioned substantially on top of said supporting arms.

13. A garment hanger retail package comprising:

at least one garment hanger having a suspension member and two support arms extending from opposite directions of said suspension member for supporting a garment;

a display tag positioned below said suspension member having a display area secured substantially vertically above at least one of said supporting arms for displaying sales information related to said garment hanger;

wherein said display tag further comprising at least two holes positioned for attaching said display tag to said garment hanger.

14. The garment hanger retail package of claim 13 wherein said retail package comprises at least a first and a second garment hanger, said first garment hanger is positioned in front of said display tag, and said second garment hanger is positioned behind said display tag.

15. The garment hanger retail package of claim 13 further comprising at least two separated fasteners provided for attaching said display tag with said display tag to said garment hanger through said holes.

16. A garment hanger retail package comprising:

at least one garment hanger having a suspension member and two support arms extending from opposite directions of said suspension member for supporting a garment;

a display tag secured behind said garment hanger, said display tag further have a substantial display area positioned vertically above and extending along at least one of said supporting arms.

17. The garment hanger retail package of claim 16 further comprising at least two separated fasteners for securing said display tag behind said garment hanger and for providing a substantial full frontal view of said garment hanger in a store.

18. The garment hanger retail package of claim 16 wherein said garment hanger is an adjustable width hanger having two stationary supporting arms and two movable arms configured to adjust the width of said hanger, wherein said fasteners are attached either to the medial portion or the stationary arms of said hanger so as not to interfere the motion of said movable arms.

19. The garment hanger retail package of claim 16 wherein said package comprises at least a first and a second garment hanger, said first garment hanger is positioned in front of said display tag, and said second garment hanger is positioned behind said display tag.

20. The garment hanger retail package of claim 17 wherein the frontal view of said garment hanger locates behind said fasteners, and that the areas of said garment hanger located behind said fasteners and said fasteners are configured to be of a same color for providing a substantial full frontal view of said garment hanger.

21. The garment hanger retail package of claim 5 wherein said package comprises at least a first and a second garment hanger, said first garment hanger is positioned in front of said display tag, and said second garment hanger is positioned behind said display tag.

* * * * *